United States Patent [19]

DeBoer

[11] Patent Number: 4,876,235

[45] Date of Patent: Oct. 24, 1989

[54] DYE-RECEIVING ELEMENT CONTAINING SPACER BEADS IN A LASER-INDUCED THERMAL DYE TRANSFER

[75] Inventor: Charles D. DeBoer, Rochester, N.Y.

[73] Assignee: Eastman Kodak Company, Rochester, N.Y.

[21] Appl. No.: 282,706

[22] Filed: Dec. 12, 1988

[51] Int. Cl.[4] ..... B41M 5/035; B41M 5/26

[52] U.S. Cl. ..... 503/227; 8/471; 428/195; 428/323; 428/327; 428/341; 428/913; 428/914

[58] Field of Search ..... 8/471; 428/913, 914, 428/195, 323, 327, 341; 503/227

[56] References Cited

U.S. PATENT DOCUMENTS 4,541,830 9/1985 Hotta et al. ..... 503/227

4,777,159 10/1988 Taguchi et al. ..... 503/227

FOREIGN PATENT DOCUMENTS 0137790 6/1986 Japan ..... 503/227

*Primary Examiner*—Bruce H. Hess

*Attorney, Agent, or Firm*—Harold E. Cole

[57] ABSTRACT

A dye-receiving element comprising a support having thereon a laser-induced thermal dye transfer image and spacer beads of such particle size and concentration that effective contact between the dye-receiving element and a dye-donor element is prevented during transfer of the laser-induced thermal dye transfer image.

20 Claims, No Drawings

DYE-RECEIVING ELEMENT CONTAINING SPACER BEADS IN A LASER-INDUCED THERMAL DYE TRANSFER

This invention relates to dye-receiver elements used in laser-induced thermal dye transfer which contain spacer beads.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-door sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy of the laser to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

There is a problem with using the laser system described above in that the transfer of dye tends to be nonuniform. In many instances, the dye-binder melts and sticks to the receiver, creating an effect called image mottle. Further, when the dye-donor is in direct contact with the dye-receiving layer, heat is lost to the dye-receiving layer from the dye-donor, cooling the dye-donor with a resultant loss in density being transferred. It would be desirable to find a way to improve the uniformity and density of dye transfer using a laser.

U.S. Pat. No. 4,541,830 and EPA No. 163,145 describe a dye-donor for thermal dye transfer wherein the dye layer contains non-sublimable particles which protrude from the surface. Although there are no examples, there is a disclosure in these references that their donor could be used for high speed recording by a laser beam.

There is no disclosure in these references, however, that the non-sublimable particles could be used in a dye-receiver element. There is an advantage in having particles in the dye-receiver instead of the dye-donor in that image mottle is reduced and a matte viewing surface is provided.

Accordingly, this invention relates to a dye-receiving element comprising a support having thereon a laser-induced thermal dye transfer image and spacer beads of such particle size and concentration that effective contact between the dye-receiving element and a dye-donor element is prevented during transfer of the laser-induced thermal dye transfer image.

Any spacer beads may be employed in the invention provided they have the particle size and concentration as described above. In general, the spacer beads should have a particle size ranging from about 3 to about 50 μm, preferably from about 5 to about 25 μm. The coverage of the spacer beads may range from about 5 to about 2,000 beads/mm$^2$.

As the particle size of the beads increases, then proportionally fewer beads are required. In a preferred embodiment of the invention, the spacer beads have a particle size from of about 3 to about 5 μm and are present at a concentration of from about 750 to about 2,000/mm$^2$. In another preferred embodiment of the invention, the spacer beads have a particle size from of about 5 to about 15 μm and are present at a concentration of from about 10 to about 1,000/mm$^2$. In still another preferred embodiment of the invention, the spacer beads have a particle size from of about 15 to about 50 μm and are present at a concentration of from about 5 to about 200/mm$^2$. The spacer beads do not have to be spherical and may be of any shape.

The spacer beads may be formed of polymers such as polystyrene, phenol resins, melamine resins, epoxy resins, silicone resins, polyethylene, polypropylene, polyesters, polyimides, etc.; metal oxides, inorganic salts, inorganic oxides, silicates, salts, etc. In general, the spacer beads should be inert and insensitive to heat at the temperature of use.

The support of the dye-receiving element of the invention may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®.

The dye image-receiving layer which is coated on the support of the dye-receiving element of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

In a preferred embodiment of the invention, the spacer beads are incorporated into the dye image-receiving layer. However, the spacer beads may also be coated as a separate layer of the dye-receiver in a binder such as higher polysaccharides e.g., starch, dextran, dextrin, corn syrup, etc.; cellulose derivatives; acrylic acid polymers; polyesters; polyvinylacetate; etc.

Any dye can be used in the dye layer of the dye-donor element employed in certain embodiments of the invention provided it is transferable to the dye-receiving layer by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

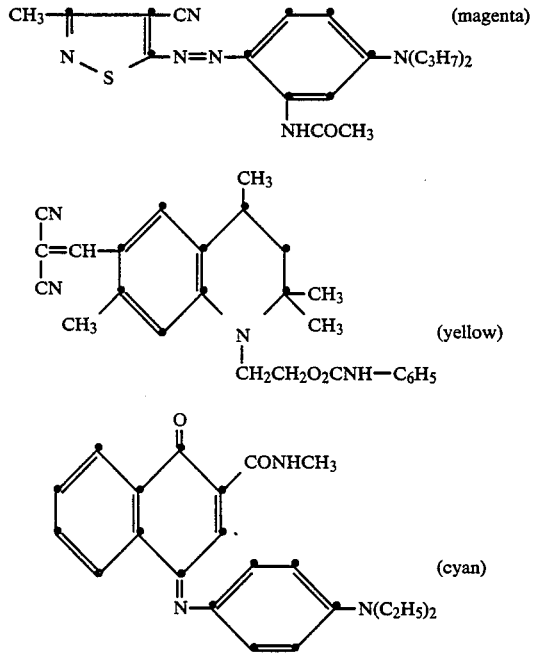

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element described above is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element described above provided it is dimensionally stable and can withstand the heat generated by the laser beam. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers. The support generally has a thickness of from about 2 to about 250 μm. It may also be coated with a subbing layer, if desired.

Any material may be used as the infrared-absorbing material in the dye-donors employed in certain embodiments of the invention such as carbon black or nonvolatile infrared-absorbing dyes or pigments which are well known to those skilled in the art. Cyanine infrared absorbing dyes may also be employed as described in DeBoer application Ser. No. 221,163 filed July 19, 1988, the disclosure of which is hereby incorporated by references.

As noted above, dye-donor elements are used to form a laser-induced thermal dye transfer image according to the invention. Such a process comprises imagewise-heating a dye-donor element as described above using a laser, and transferring a dye image to a dye-receiving element as described above to form the laser-induced thermal dye transfer image.

After the dyes are transferred to the receiver, the image may be thermally fused to stabilize the image. This may be done by radiant heating or by contact with heated rollers. The fusing step aids in preventing fading of the image upon exposure to light and also tends to prevent crystallization of the dyes. Solvent vapor fusing may also be used instead of thermal fusing.

Several different kinds of lasers could conceivably be used to effect the thermal transfer of dye from a donor sheet to a receiver, such as ion gas lasers like argon and krypton; metal vapor lasers such as copper, gold, and cadmium; solid-state lasers such as ruby or YAG; or diode lasers such as gallium arsenide emitting in the infrared region from 750 to 870 nm. However, in practice, the diode lasers offer substantial advantages in terms of their small size, low cost, stability, reliability, ruggedness, and ease of modulation. In practice, before any laser can be used to heat a dye-donor element, the laser radiation must be absorbed into the dye layer and converted to heat by a molecular process known as internal conversion. Thus, the construction of a useful dye layer will depend not only on the hue, sublimability and intensity of the image dye, but also on the ability of the dye layer to absorb the radiation and convert it to heat.

Lasers which can be used to transfer dye from the dye-donor elements are available commercially. There can be employed, for example, Laser Model SDL-2420-H2 ® from Spectrodiode Labs, or Laser Model SLD 304 V/W ® from Sony Corp.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is adjacent to and overlying the image-receiving layer of the receiving element.

The above assemblage comprising these two elements may be preassembled as an integral unit when a monochrome image is to be obtained. After transfer, the dye-receiving element is then peeled apart to reveal the dye transfer image.

When a three-color image is to be obtained, the above assemblage is formed on three occasions during the time when heat is applied using the laser beam. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

A) A cyan dye-donor element was prepared by coating on a 100 μm gelatin-subbed poly(ethylene terephthalate) support:

a dye layer containing the cyan dye illustrated above (0.33 g/m$^2$), the bis indolylcyanine dye illustrated below (0.16 g/m$^2$), and Dow Corning DC-510® surfactant (0.10 g/m$^2$) in a cellulose acetate propionate (2.5% acetyl, 45% propionyl) binder (0.30 g/m$^2$) coated from a cyclohexanone, butanone and dimethylformamide solvent mixture.

A dye-receiving element was prepared by coating on a poly(methyl acrylate-co-vinylidene chloride-co-itaconic acid) (0.11 g/m$^2$) subbed polyethylene terephthalate support a layer of poly(methyl-methacrylate-co-divinylbenzene) (97:3 wt. ratio) (8–12 μm diameter spherical beads) at the coverage indicated in Table 1 below, Dow Corning DC-510® surfactant (0.10 g/m$^2$) in a Lexan® 101 (General Electric) bisphenol-A polycarbonate binder (1.7 g/m$^2$) from a chlorobenzene and dichloromethane solvent mixture. The number of beads per square millimeter in each coating was estimated by counting under a microscope.

The dye-receiving element containing the polymeric spacer beads was overlaid with the dye-donor, placed on the drum of a laser exposing device and a vacuum to 600 mm pressure was applied to hold the donor to the receiver. The assembly was then exposed on the 180 rpm rotating drum to a focused 830 nm laser beam from a Spectrodiode Labs Laser Model SDL-2420-H2® using a 30 μm spot diameter and an exposure time of approximately 100 microsec. to transfer areas of dye to the receiver. The power level was 86 milliwatts and the exposure energy was 44 microwatts/sq. micron.

After dye transfer, the receivers were inspected for non-uniformities and relative grainy surface caused by sticking of the donor to the receiver. The following results were obtained:

TABLE 1

| Dye Receiver | Bead Conc. (g/m$^2$) | Beads per mm$^2$ | Donor/Rec. Sticking | Graininess |
|---|---|---|---|---|
| Control | 0 | 0 | Yes | Unacceptable |
| Control | 0.002 | 7 | Yes | Unacceptable |
| Invention | 0.010 | 31 | No | Moderate |
| Invention | 0.020 | 50 | No | Acceptable |
| Invention | 0.13 | 300 | No | Acceptable |
| Invention | 0.26 | 490 | No | Acceptable |

Unacceptable - Graininess and mottle were so severe as to make the image commercially valueless.
Moderate - Graininess and mottle were noticeable over substantial areas.
Acceptable - Observed mottle was minimal.

The above results indicate that at least 30 beads/mm$^2$ of 8–12 μm diameter are required in the dye-receiver layer to prevent sticking and obtain good image quality.

Infrared absorbing indolyl dye:

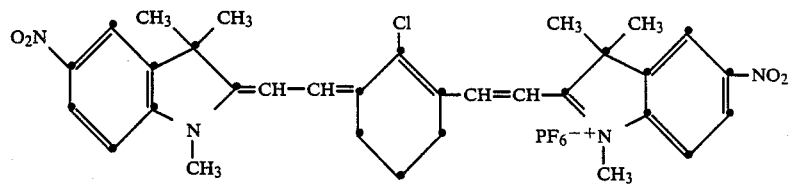

This dye is the subject of Application Serial Number 221,163 of DeBoer filed July 19, 1988.

EXAMPLE 2

Dye-donors were prepared as in Example 1.

Dye-receivers were prepared as in Example 1 except that the polymeric beads were poly(styrene-co-divinylbenzene) 90:10 wt. ratio) (19–21 μm in diameter).

Imaging and evaluation were as in Example with the following results:

TABLE 2

| Dye Receiver | Bead Conc. (g/m$^2$) | Beads per mm$^2$ | Donor/Rec. Sticking | Graininess |
|---|---|---|---|---|
| Control | 0 | 0 | Yes | Unacceptable |
| Control | 0.002 | 2 | Yes | Unacceptable |
| Control | 0.010 | 3 | Yes | Unacceptable |
| Invention | 0.020 | 12 | No | Acceptable |
| Invention | 0.13 | 80 | No | Acceptable |
| Invention | 0.26 | 96 | No | Acceptable |

The above results indicate that at least 10 beads/mm$^2$ of about 20 μm diameter are required in the dye-receiver layer to prevent sticking and obtain good image quality.

EXAMPLE 3

Dye-donors were prepared as in Example 1.

Dye-receivers were prepared as in Example 1 except that the polymeric beads were divinylbenzene cross-linked polystyrene (3 μm in diameter).

imaging and evaluation were as in Example with the following results:

TABLE 3

| Dye Receiver | Bead Conc. (g/m$^2$) | Beads per mm$^2$ | Donor/Rec. Sticking | Graininess |
|---|---|---|---|---|
| Control | 0 | 0 | Yes | Unacceptable |
| Control | 0.002 | 22 | Yes | Unacceptable |
| Control | 0.010 | 97 | Yes | Unacceptable |
| Control | 0.020 | 560 | Yes | Unacceptable |

TABLE 3-continued

| Dye Receiver | Bead Conc. (g/m²) | Beads per mm² | Donor/Rec. Sticking | Graininess |
|---|---|---|---|---|
| Invention | 0.10 | 970 | No | Acceptable |

The above results indicate that at least 750 beads/mm² of about 3 μm diameter are required in the dye-receiving layer to prevent sticking and obtain good image quality.

The invention has been described in detail with particular reference to preferred embodiments thereof, but it will be understood that variations and modifications can be effected within the spirit and scope of the invention.

What is claimed is:

1. A dye-receiving element comprising a support having thereon a dye-receiving layer containing a laser-induced thermal dye transfer image, said element containing spacer beads of such particle size and concentration that effective contact between said dye-receiving element and a dye-donor element is prevented during transfer of said laser-induced thermal dye transfer image, said spacer beads being located either in said dye-receiving layer or in a layer thereover.

2. The element of claim 1 wherein said spacer beads have a particle size of from about 3 to about 50 μm.

3. The element of claim 1 wherein said spacer beads are present at a concentration of from about 5 to about 2,000/mm².

4. The element of claim 1 wherein said spacer beads have a particle size from of about 3 to about 5 μm and are present at a concentration of from about 750 to about 2,000/mm².

5. The element of claim 1 wherein said spacer beads have a particle size from of about 5 to about 15 μm and are present at a concentration of from about 10 to about 1,000/mm².

6. The element of claim 1 wherein said spacer beads have a particle size from of about 15 to about 50 μm and are present at a concentration of from about 5 to about 200/mm².

7. The element of claim 1 wherein said spacer beads are poly(methyl methacrylate-co-divinylbenzene) or poly(styrene-co-divinylbenzene).

8. In a process of forming a laser-induced thermal dye transfer image comprising (a) imagewise-heating by means of a laser a dye-donor element comprising a support having thereon a dye layer and an infrared-absorbing material, and (b) transferring a dye image to a dye-receiving layer of a dye-receiving element to form said laser-induced thermal dye transfer image, the improvement wherein said dye-receiving element comprises a support having thereon spacer beads of such particle size and concentration that effective contact between said dye-receiving element and said dye-donor element is prevented during transfer of said laser-induced thermal dye transfer image, said spacer beads being located either in said dye-receiving layer or in a layer thereover.

9. The process of claim 8 wherein said spacer beads have a particle size of from about 3 to about 50 μm.

10. The process of claim 8 wherein said spacer beads are present at a concentration of from about 5 to about 2,000/mm².

11. The process of claim 8 wherein said spacer beads have a particle size from of about 3 to about 5 μm and are present at a concentration of from about 750 to about 2,000/mm².

12. The process of claim 8 wherein said spacer beads have a particle size from of about 5 to about 15 μm and are present at a concentration of from about 10 to about 1,000/mm².

13. The process of claim 8 wherein said spacer beads have a particle size from of about 15 to about 50 μm and are present at a concentration of from about 5 to about 200/mm².

14. The process of claim 8 wherein said spacer beads are poly(methyl metacrylate-co-divinylbenzene) or poly(styrene-co-divinylbenzene).

15. In a thermal dye transfer assemblage comprising:

a) a dye-donor element comprising a support having a dye layer and an infrared absorbing material, and b) a dye-receiving element comprising a support having thereon a dye image-receiving layer, said dye-receiving element being in a superposed relationship with said dye-donor element so that said dye layer is adjacent to said dye image-receiving layer, the improvement wherein said dye image-receiving layer contains spacer beads of such particle size and concentration that effective contact between said dye-receiving element and said dye-donor element is prevented during transfer of a laser-induced thermal dye transfer image, said spacer beads being located either in said dye-receiving layer or in a layer thereover.

16. The assemblage of claim 15 wherein said spacer beads have a particle size of from about 3 to about 50 μm.

17. The assemblage of claim 15 wherein said spacer beads are present at a concentration of from about 5 to about 2,000/mm².

18. The assemblage of claim 15 wherein said spacer beads have a particle size from of about 3 to about 5 μm and are present at a concentration of from about 750 to about 2,000/mm².

19. The assemblage of claim 15 wherein said spacer beads have a particle size from of about 5 to about 15 μm and are present at a concentration of from about 10 to about 1,000/mm².

20. The assemblage of claim 15 wherein said spacer beads have a particle size from of about 15 to about 50 μm and are present at a concentration of from about 5 to about 200/mm².

* * * * *